US007548051B1

(12) United States Patent
Tenbroek et al.

(10) Patent No.: US 7,548,051 B1
(45) Date of Patent: Jun. 16, 2009

(54) LOW DROP OUT VOLTAGE REGULATOR

(75) Inventors: Bernard Mark Tenbroek, West Malling (GB); Christopher Geraint Jones, Maidstone (GB)

(73) Assignee: MediaTek Inc. (TW)

( * ) Notice: Subject to any disclaimer, the term of this patent is extended or adjusted under 35 U.S.C. 154(b) by 0 days.

(21) Appl. No.: 12/034,984

(22) Filed: Feb. 21, 2008

(51) Int. Cl.
*G05F 3/16* (2006.01)

(52) U.S. Cl. ..... 323/315; 323/312; 323/314; 323/273

(58) Field of Classification Search ..... 23/282, 23/312, 315, 314, 316, 273, 274, 270, 271
See application file for complete search history.

(56) References Cited

U.S. PATENT DOCUMENTS 4,442,398 A * 4/1984 Bertails et al. ..... 323/315
4,471,292 A * 9/1984 Schenck et al. ..... 323/315
6,081,107 A * 6/2000 Marino ..... 323/282
6,188,212 B1 * 2/2001 Larson et al. ..... 323/281

* cited by examiner

*Primary Examiner*—Akm E Ullah
*Assistant Examiner*—Nguyen Tran
(74) *Attorney, Agent, or Firm*—Fish & Richardson P.C.

(57) ABSTRACT

A low drop out voltage regulator, comprising first and second field effect transistors arranged in series between a regulator input and a regulator output; a third field effect transistor co-operating with the first field effect transistor to form a first current mirror; a fourth field effect transistor co-operating with the second field effect transistor to form a second current mirror; first and second control transistors, which advantageously are bipolar transistors connected in series with the third and fourth field effect transistors respectively so as to control the current flowing therein; and a controller for providing a control signal to the first and second bipolar transistor as a function of a voltage at the regulator output.

16 Claims, 3 Drawing Sheets

LOW DROP OUT VOLTAGE REGULATOR

FIELD OF THE INVENTION

The present invention relates to a low drop out voltage regulator.

BACKGROUND OF THE INVENTION

Portable electronic devices, such as mobile telephones and ultra portable computing devices, frequently use batteries to power them. At the time of writing such devices typically use 3.6 volt rechargeable batteries. However these batteries have a start of life voltage of up to 4.2 volts and, if the user removes the battery whilst keeping the battery charger connected to the device then the voltage provided by some poorly regulated chargers can increase to 5.5 volts or so. Therefore a voltage regulator is provided between the battery and the circuits that it powers in order to ensure that these circuits see a nominally constant voltage. These circuits are often digital circuits and are commonly fabricated using sub-micron CMOS integrated circuit manufacturing technology which often has a maximum supply voltage of 3.6 volts or lower.

Whilst an additional circuit may be provided to act as the low drop out voltage regulator, and the additional circuit could use transistors formed in a different technology, it would be advantageous if the voltage regulator could be implemented on the same semi-conductor die as the CMOS integrated circuits.

SUMMARY OF THE INVENTION

According to the present invention there is provided a low voltage drop out regulator comprising:

- first and second field effect transistors arranged in series between a regulator input and a regulator output;
- a third field effect transistor co-operating with the first field effect transistor to form a first current mirror;
- a fourth field effect transistor co-operating with the second field effect transistor to form a second current mirror;
- first and second control transistors connected in series with the third and fourth field effect transistors respectively so as to control the current flowing in the third and fourth field effect transistors; and
- a controller for providing a control signal to the first and second control transistors as a function of a voltage at the regulator output.

Preferably the control transistors are bipolar transistors. However the control transistors could also be formed by a plurality of series connected field effect transistors—in much the same configuration as the first and second field effect transistors are. Advantageously the bipolar transistors are parasitic devices formed with the creation of the field effect transistors. Such parasitic transistors have large dimensions compared to the field effect transistors and this gives them break-down voltages in excess of the break-down voltage of the field effect transistors. It should also be noted that other options such as MOS or DMOS devices could be used.

By placing the first and second field effect transistors in series it becomes possible to share the voltage drop between the regulator input voltage and the regulator output voltage across the transistors. Thus even though the voltage difference between the regulator input voltage and the regulator output voltage may exceed the breakdown voltage for the implementing transistor technology, with care this voltage can be equally shared between the transistors such that each is subjected to less than its breakdown voltage.

Advantageously a biasing arrangement is provided for each of the first and second transistors which acts to share the voltage drop equally across them. Advantageously the biasing arrangement is provided by current mirrors. The inventors realised that use of a current mirror action would cause voltage stabilisation to occur locally at each of the first and second transistors. As such, one would expect that the transistors are reasonably well matched. In use, each of the first and second transistors is the "slave" transistor in a current mirror and the "master" transistors of a current mirror are each controlled to pass the same current. However the first and second transistors are in series so, by Kirchoffs laws, they have to pass the same current. The interaction that this creates causes the drain-source voltage of each transistor to tend towards the same value, thereby causing the voltage drop between the regulator input and the regulator output to be equally divided between the transistors.

This technique is extensible so further transistors could be provided in series with the first and second transistors to allow for an even greater voltage drop to be accommodated by the regulator.

Advantageously each of the first and second transistors is in parallel with a bypass arrangement which allows the voltage drop occurring across the transistors to be equally divided between them even when the transistors are switched into a non-conducting state. In a preferred embodiment each transistor has a plurality of series connected diodes in parallel with it. The diodes are selected such that the voltage drop across each individual diode junction is less than the 0.6 to 0.7 volts that would normally be expected to turn the diode on. Under these conditions a very small leakage current exists which acts to distribute the voltage between the first and second transistors. Other bypass arrangements could be used such as diode connected transistors.

BRIEF DESCRIPTION OF THE FIGURES

The present invention will further be described by way of non-limiting example only, with reference to the accompanying drawings, in which.

DESCRIPTION OF PREFERRED EMBODIMENT OF THE INVENTION

Figure 1:
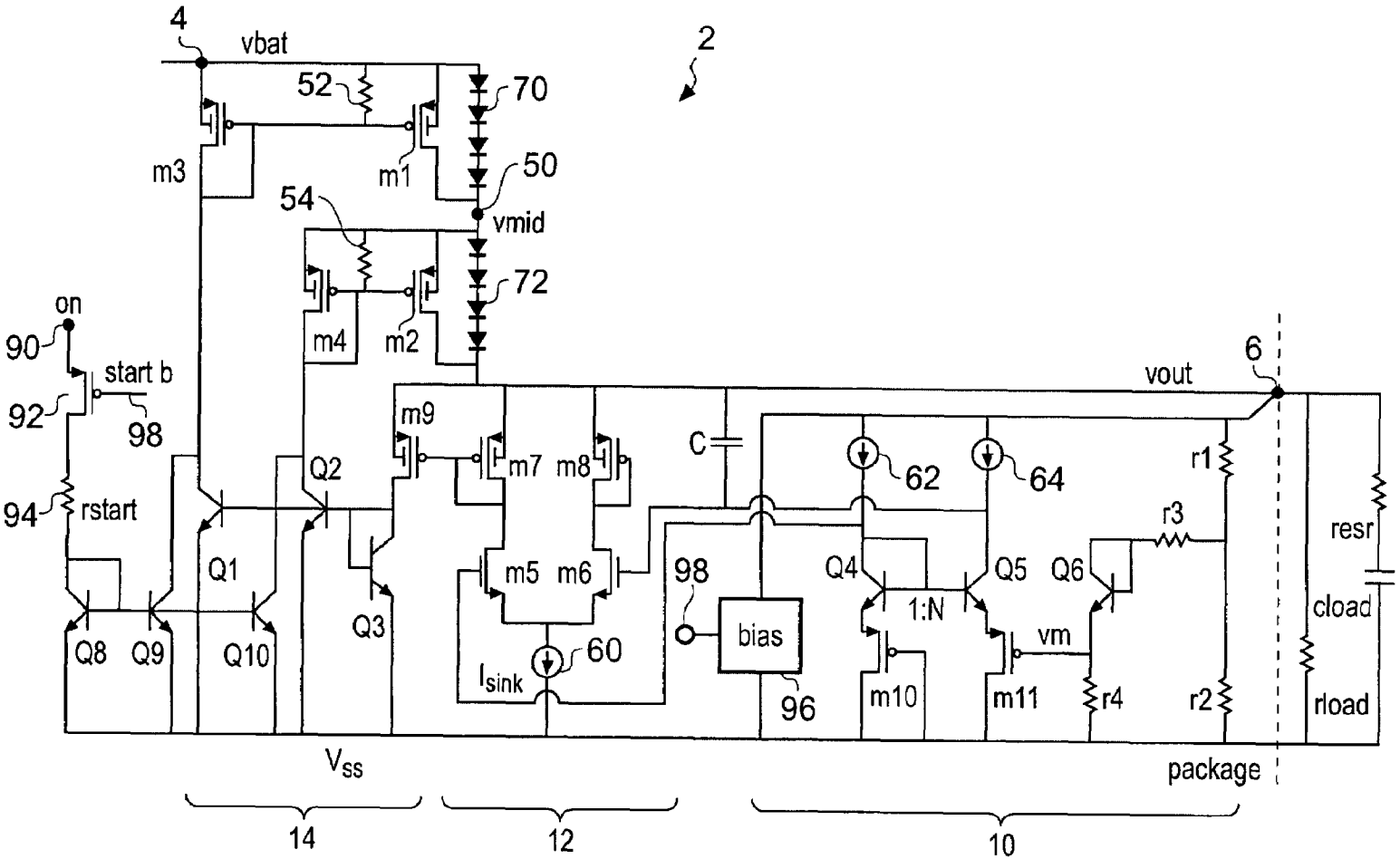
FIG. 1 is a circuit diagram of a low voltage drop out regulator constituting a preferred embodiment of the present invention.

FIG. 1 is a circuit diagram of a low drop out voltage regulator, generally indicated 2, which serves to accept an unregulated voltage at an input node 4 and to provide a regulated voltage at an output node 6. In broad terms, the low drop out voltage regulator consists of three main stages, namely an error amplifier with built in band gap reference, generally designated 10, an inverter stage (with a compensation capacitor) generally designated 12 and an output driving network generally designated 14. The design of the inverting stage is discussed more fully in U.S. Pat. No. 5,631,598, the teachings of which are incorporated by reference. The purpose of the error amplifier is to measure the voltage occurring at the output node 6 and to compare it with a reference voltage and on that basis to output a signal indicating the size and direction of the error between the actual output voltage and a target output voltage. This error is amplified within the inverting amplifier 12 and then supplied to the output stage driving network 14. The output stage driving network 14 also has the task of ensuring that the voltage dropped by the regulator 2 is equally distributed across the first and second series connected power transistors M1 and M2, respectively.

Figure 2A:
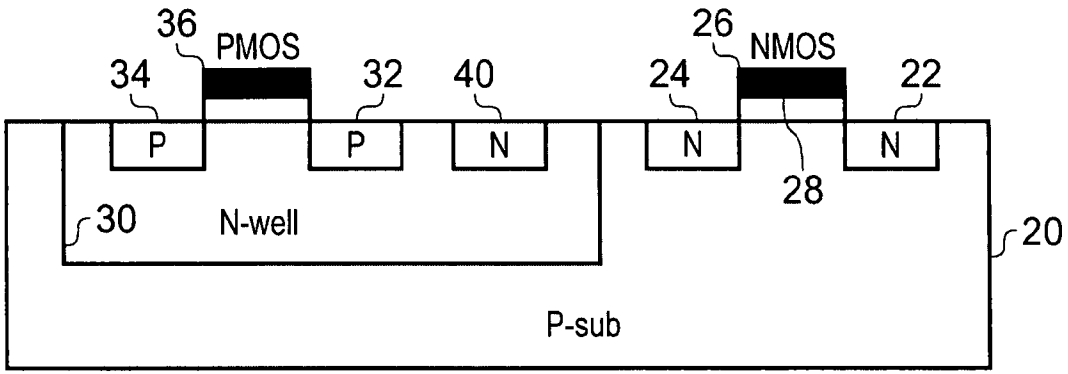
FIGS. 2*a* and 2*b* schematically illustrates the structure of NMOS and PMOS transistors within a CMOS integrated circuit.

The regulator shown in FIG. 1 can be regarded as a "high side" voltage regulator in that the power transistors M1 and M2 are in the positive voltage rail between a power source and a load. It will be appreciated that by an appropriate selection of components the regulator could also be implemented as a low side regulator. However for simplicity the following discussion will focus on the implementation of a high side regulator. The first and second power transistors M1 and M2 are P-type field effect transistors connected in series between the voltage regulator input 4 and the voltage regulator output 6. It is often convenient to think of a field effect transistor as being a three terminal device having a source, a drain and a gate. However, as can be seen in FIG. 2, the field effect transistor is really a four terminal device comprising a source, a drain, a gate and a back gate. FIG. 2*a* shows a structure of a PMOS transistor and an NMOS transistor within an integrated circuit. Typically the integrated circuit will have a substrate 20 which is doped so as to form a first type of semiconductor, which in this example is a P-type such that we have a P-type substrate. In order to form an NMOS transistor N-type regions 22 and 24 are formed in the substrate. A space exists between the regions 22 and 24 which is filled by a gate 26 deposited over an insulating layer 28 such as silicon dioxide.

The formation of a P-type field effect transistor is more complex. Firstly an N-type well 30 has to be formed within a region of the P-type substrate 20. Having formed the N-type well P-type regions 32 and 34 are formed in order to create the source and drain of the PMOS field effect transistor. The space between the source and drain regions is covered by a metallised gate 36 which, as with the N-type transistor, sits above a layer of insulating material. Thus so far the structure of the P-type field effect transistor mirrors that of the N-type field effect transistor with the addition of the fact that the P-type transistor is formed within an N-type well 30 within the P-type substrate 20. However, an additional step has to be taken in order to ensure that there is no current flow between the N-type well 30 and the P-type substrate 20. Thus a further N-type region 40 is formed within the N-type well 30 such that a voltage can be applied via this further region to bias the parasitic diode formed between the N-type well 30 and the P-type substrate 20 into an off state. This further electrode 40 is referred to as a "back gate".

Figure 2B:
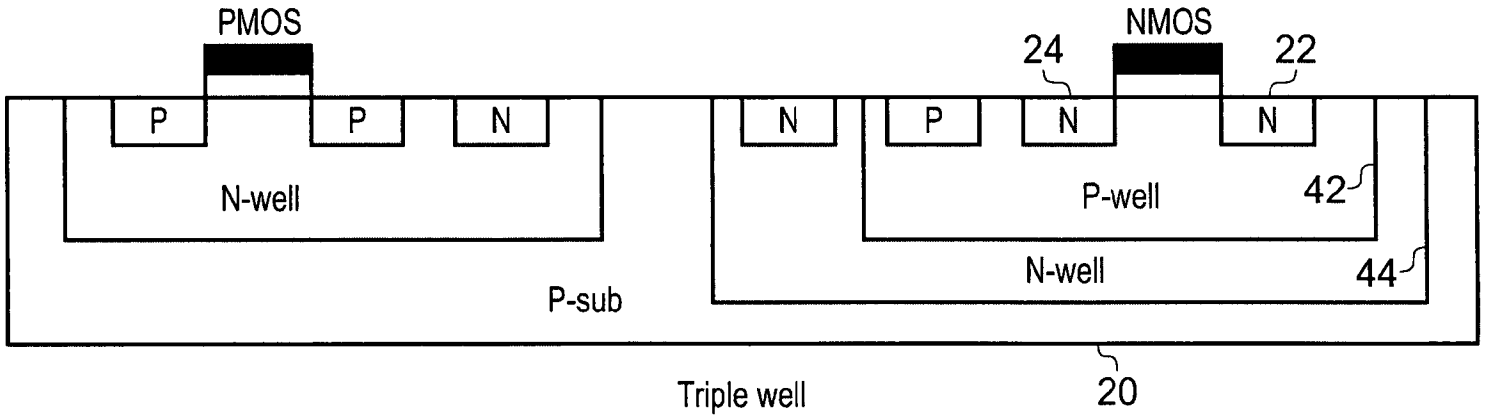

It should be noted that the process described with respect to FIG. 2*a* can be varied as shown in FIG. 2*b*. This variation is readily available at semiconductor fabrication facilities. In the variation the NMOS devices are not formed directly within the substrate but instead are isolated from it. In order to achieve this the NMOS device is fabricated within a P-well 42 which is formed in a deep N-well 44 within the P-type substrate 20.

It is worth noting that as part of the CMOS application process several parasitic components are inevitably formed. Thus parasitic diodes can be formed whenever there is a junction between an N-type and a P-type semiconductor and normally steps are taken to ensure that the voltages applied within the circuit bias these diodes into the off state. Similarly parasitic bi-polar transistors are created. For example vertical NPN bi-polar transistors can be formed by the interaction between the N-type channels 22 of the NMOS device the P-well 42 an the N-well 44 in FIG. 2*b* with the P-type substrate whereas parasitic PNP transistors can be formed in the vicinity of the P-type field effect transistors. The inventors noted that these parasitic transistors typically have dimensions which are much larger than the CMOS devices that were specifically fabricated within the integrated circuit. The breakdown voltage of the transistor within the integrated circuit depends greatly upon the size of the device and consequently these parasitic bi-polar transistors have much larger breakdown voltages because their physical structure extends over larger distances. In practical terms this means that a semiconductor process such as a 3.6 volt CMOS process generates CMOS transistors which have breakdown voltages safely above 3.6 volts to provide reliable operation at this voltage, but also generates parasitic bi-polar transistors which have significantly higher breakdown voltages. The inventors have realised that these parasitic bi-polar transistors could be utilised in the formation of an integrated voltage regulator. However the inventors have also realised that the transistors, being parasitic in their nature, exhibit low gains.

Returning to FIG. 1, we see that the transistors M1 and M2 are series connected. However it is important that each transistor sees the same bias and operating conditions in order to ensure good matching. In practical terms, this means that the back gate of the first transistor M1 is connected to the source of the first transistor M1 whereas the back gate of the second transistor M2 is connected to the source of the second transistor M2. The source of the first transistor M1 is connected to the input node 4 and the drain of the first transistor M1 is connected to the source of the second transistor M2. The drain of the second transistor M2 is connected to the regulator output 6. To aid subsequent understanding of the circuit, it is convenient to think of an intermediate node 50 existing between the drain of the first transistor M1 and the source of the second transistor M2.

The first transistor M1 is associated with a further P-type field effect transistor M3 such that these devices form a current mirror. Therefore, a source of the transistor M3 is also connected to the input node 4 such that the source voltages of transistors M1 and M3 are identical. The gates of the transistors M1 and M3 are connected together such that the gate voltages are identical. However the gate of transistor M3 is connected to the drain of transistor M3 in order to form the "master" transistor of the current mirror. In use, current is drawn through the transistor M3 and this will cause the gate voltage, and more particularly the gate-source voltage $V_{GS}$, of M3 to take whatever value is required in order to support that current flow. Of course $V_{GS}$ of M3 is supplied to M1 and hence M1 will also try to pass the same current, subject to any scaling between the relative sizes of the transistors. In the arrangement shown in FIG. 1 M1 is significantly larger than M3, for example a factor of a thousand or so, such that the current that M1 tries to pass will be the same as the current passing through M3 multiplied by the scaling factor. Thus, if M1 is 1000 times larger than M3 then M1 will seek to pass 1000 times the current passing through M3.

A second current mirror comprising the second transistor M2 and a fourth P-type field effect transistor M4 is also provided. A second current mirror has a design similar to that of the first current mirror. Thus the source of transistor M4 is connected to the source of transistor M2, the gate of transistor M4 is connected to the gate of transistor M2 and the gate of transistor M4 is also connected to the drain of the second transistor M4. M4's back gate is also connected to its source. Thus, as with the first current mirror, the current flowing through the transistor M2 of the second current mirror is controlled by the current flowing through M4 but subject to the scaling factor between the transistors M2 and M4. In practice current mirrors are matched such that each exhibits the same scaling factor.

In use, the currents passing through transistors M3 and M4 are identical and this has the consequence that each of the transistors M1 and M2 tries to pass the same current. Inevitably in the absence of any alternative current flow paths they have to pass the same current because they are series connected. However, because each transistor M1 and M2 is seeking to pass the same current and each transistor M1 and M2 has the same gate source voltage, then under ideal conditions each transistor M1 and M2 has the same drain-source voltage, and consequently the voltage drop between the input node 4 and the output node 6 is shared equally between the transistors M1 and M2. In practise slight mismatching between the devices may occur, but this only results in slight differences between the drain source voltages occurring across each transistor.

In order to ensure that M1 and M2 are biased strongly into the non-conducting state when the voltage regulator is off high value pull-up resistors are provided. A first resistor 52 extends between the gate of transistor M1 and its source whereas a similar resistor 54 is provided for transistor M2. The provision of these resistors stops the gate voltage floating when the regulator is off. However, it can be seem that in the off state when no current is being drawn through the transistor M3 then the presence of the resistor 52 allows the drain voltage of M3 to float towards the voltage at the regulator input node 4. This means that a breakdown voltage in excess of the CMOS breakdown voltage could be experienced by a device connected between the drain of M3 and the low voltage rail $V_{SS}$. A device in this position, which can be considered as being a control transistor, must also control the current drawn through the third transistor M3. The inventors realised that one of the parasitic bi-polar transistors could be placed in this position as it can be used to both control the current passing through M3 and also has the capability to withstand the entirety of the voltage drop that might occur across it when, for example, a power supply is still attached to the portable device but the battery has been removed. Consequently one of the parasitic NPN bi-polar transistors, designated Q1, is connected such that its collector is connected to the drain of the transistor M3 whereas the emitter of Q1 is connected to the low voltage rail $V_{SS}$, either directly as shown in FIG. 1 or potentially via a degenerating resistor. Similarly a second parasitic NPN bi-polar transistor is connected between the drain of the fourth field effect transistor M4 and the low voltage rail $V_{SS}$. Base terminals of the transistors Q1 and Q2 can be connected together and in a current mirror configuration to the base and collector terminals of a further NPN transistor Q3 such that the current flowing in the first current mirror formed by transistor M1 and M3 is identical to the current flowing in the second current mirror by transistors M3 and M4 because the current flowing in transistors Q1 and Q2 is identical to that flowing in transistor Q3 by virtue of the current mirror action formed around transistors Q1, Q2 and Q3.

Q3 is driven by the inverter stage 12. The inverter stage uses the classic long tail pair configuration that is often used in differential amplifiers. N-type field effect transistors M5 and M6 form the differential input stage with the gate of M5 forming one input to the differential amplifier and the gate of M6 forming the other input. The sources of M5 and M6 are connected together and via a constant current sink 60 to the ground or lower voltage supply rail $V_{SS}$. It is important to note that the sum of the current flowing through M5 and M6 is a constant value set by the current sink 60 and that, in the limiting case where one of transistors M5 or M6 is switched hard off and the other one of the transistors M5 or M6 is on, then the maximum current flowing through either transistor is set to the value $I_{SINK}$ determined by the current sink 60. In order to ensure the circuit symmetry the drain of each transistor M5 and M6 is connected to an active load. The active load for transistor M5 is formed by a PMOS transistor M7 whose source is connected to the regulator output node 6, whose drain is connected to the drain of transistor M5 and whose gate is also connected to its drain such that the transistor M7 is in a diode connected configuration. A similarly configured transistor M8 forms the active load for transistor M6. The transistor M7 also forms the "master" transistor for a further current mirror formed between transistor M7 and M9. Thus M9 is a P-type field effect transistor whose source is connected to the source of M7 and whose gate is connected to the gate of M7. Thus, because the gate-source voltage of each transistor is the same then notionally each transistor will try to conduct the same current subject to any scaling factors between them. Transistor M9 is provided in series with the collector of transistor Q3 such that M9 controls the amount of current flowing through transistor Q3.

An important consequence of this repeated use of current mirrors in stages 12 and 14 is that the current flowing through the current sink 60 directly controls the maximum current that can pass through the transistors M5 and M7, and consequently the maximum current that can pass through transistor M9 and Q3, and thereby the maximum current that flows through transistors Q1 and Q2, and hence the maximum current that flows through transistors M3 and M4 and thereby the maximum current that can flow through transistors M1 and M2. Thus the transistors M1 and M2, although they normally act to provide voltage regulation, in the limiting case can be relied upon to provide current limiting because the action of the various current mirrors in association with the current sink 60 limits the maximum current that these transistors are allowed to pass. Low drop out regulators often implement current limiting to protect on-chip wiring and bondwires from damaging currents during start up, over-load or short circuit conditions but most regulators require additional circuitry to implement the current limiting feature. Here it becomes available as part of the inherent design.

The error amplifier 10 will now be briefly described. Any error amplifier configuration having either a dual ended or single ended output could be used as, in use, one of the inputs of the differential amplifier formed by M5 and M6 could be tied to a reference voltage. The error amplifier comprises three bi-polar NPN transistors Q4, Q5 and Q6 of which Q4 and Q5 are arranged in a current mirror configuration with Q4 acting as the "master". A collector of Q4 receives a current from a current source 62 whereas the collector of Q5 receives current from a current source 64. The current sources 62 and 64 are matched such that they provide the same current. The emitter of Q4 is connected to the source of a P-type field effect transistor whose gate and a drain are connected to $V_{SS}$. The emitter of Q5 is also connected to a source of a P-type field effect transistor whose drain is connected to $V_{SS}$. However the gate of this further field effect transistor M11 is connected to a further network comprising resistors r1 to r4, and transistor Q6. The transistor Q6 has its emitter connected to the gate of field effect transistor M11 and to $V_{SS}$ via resistor r4. The base and collector of transistor Q6 are connected together and via resistor r3 to a node formed between series connected resistors r1 and r2 that extend between the regulator output node 6 and $V_{SS}$. An emitter ratio 1 to N exists between transistors Q4 and Q5. The output voltage at the collector of Q4 is independent of the output voltage $V_{out}$, whereas the output voltage at the collector of Q5 varies. When the LDO is in equilibrium the differential output voltage of the error amplifier is zero and the output voltage of the LDO $V_{out}$ is represented by the equation $$V_{out} = \frac{V_1 L_n(N)}{r4}\left(r3 + \frac{r1r2}{r1 + r2}\right) + V_{be}$$

where $V_t$ is the thermal voltage $$\left(V_t = \frac{kT}{q}\varphi 25\ \text{mV}\right)$$

$L_n$ represents the natural logarithm,

N is the ratio between Q4 and Q5 and $V_{be}$ represents the band gap base emitter voltage of a bipolar transistor.

Thus, in use, the error amplifier 10 measures the voltage $V_{out}$, compares it with its inherent internal reference voltage, and produces an error voltage which is provided to the gate of M6 and which is compared to a reference which is provided to the gate of M5. Depending on the difference between these voltages, either more current or less current flows through transistors M7, M9, Q3 and hence Q1 and Q2 and ultimately through M1 and M2 such that the voltage of the output node 6 is stabilised towards a target voltage. In order to provide stability a compensation capacitor C extends between the output node 6 and the voltage provided to the gate of transistor M6.

A mobile device, or indeed any device, need not always be on and consequently the voltage regulator must also cope with these conditions. In the off condition transistors M1 and M2 are biased fully off. We may assume that a load remains permanently connected to the regulator, for example because it is integrated into a personal communications device such as a mobile telephone and the load can be represented by a resistor $R_{load}$ optionally in parallel with a capacitor. Therefore in the off condition $V_{out}$ which is the voltage at the output node 6 tends towards $V_{SS}$. Under these conditions the full unregulated voltage occurring at the input node 4 occurs across the first and second transistors M1 and M2. Therefore even in the off state some precaution must be taken to ensure that the voltage dropped across the series connected transistors M1 and M2 is shared equally between them such that neither exceeds its breakdown voltage. In a preferred embodiment each transistor is associated with its own diode stack connected in parallel to it. The first diode stack 70 comprises four series connected bypass diodes and similarly the second diode stack 72 also comprises four serially connected bypass diodes. Normally diodes are regarded as passing substantially no current until the diode threshold voltage of approximately 0.6 to 0.7 volts is exceeded. However in reality this is not true and the current through the diode can be approximated by the equation $$I = I_0\left(\exp\left(\frac{eV}{kT}\right) - 1\right)$$

where

Figure 3:
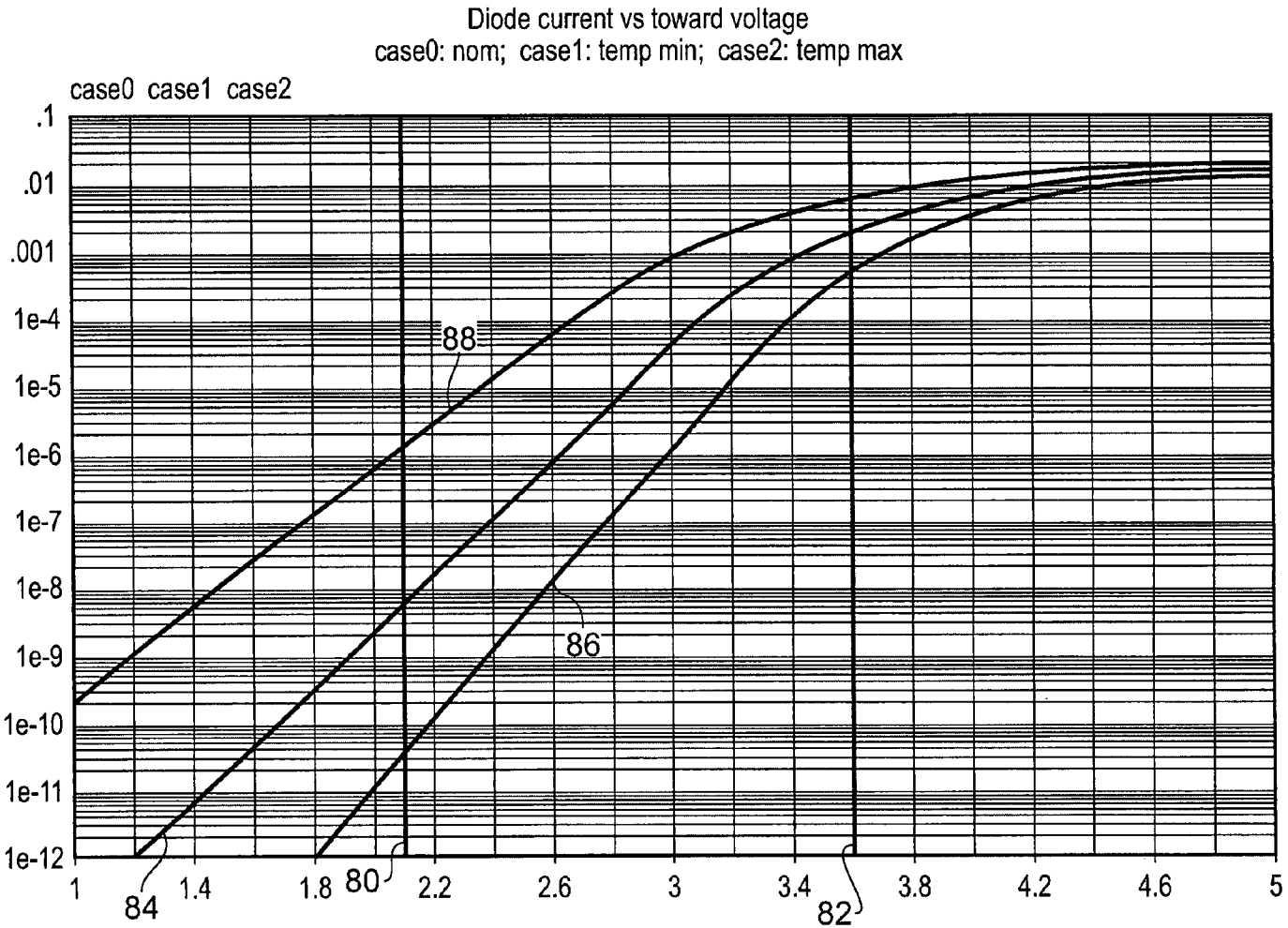
FIG. 3 is a plot showing the leakage current through the diode stacks in series with the first and second transistors in the circuit illustrated in FIG. 1.

I is the current through the diode $I_0$ is the saturation current e is the electron charge T equals the temperature in kelvin V equals volts k equals Boltzmann's constant Thus, for a forward biased diode there is always a current flow but typically when the voltage across the diode is less than the 0.6 to 0.7 volts normally regarded as the turn on voltage then the current is very very small. The inventors have utilised this feature to ensure that the voltage at the intermediate node 50 takes a value $V_{mid}$ which is substantially half of the voltage at the input node 4 when the regulator is in the off mode, but that the current passing through the diode stack in order to achieve this condition is very very small. FIG. 3 schematically shows the current passing through the diode stacks as a function of the voltage $V_d$ across each diode stack.

Taking the situation of a mobile telephone using the 3.6 volt battery technology, then the start up voltage of the battery is around 4.2 volts so each diode stack would have to drop 2.1 volts as represented by the vertical line 80. The graph also shows a further vertical line 82 at 3.6 volts representing the maximum permissible voltage that may be dropped across either one of the transistors M1 and M2. The graph also includes three curves with the curve 84 representing the nominal current flow through the diodes and curves 86 and 88 representing the worst case characteristics as a result of process variation during fabrication and temperature variation. Thus, we see that in the off state with a fully charged battery the voltage dropped across each stack should be 2.1 volts and that the current flow through the voltage stack as represented by line 84 should be around 8 nA. This is truly insignificant and does not represent an unacceptable drain on the battery. Even in the worst case scenario as represented by line 88 the current drain is about 2 μA (microamps) and this is again small compared to the internal discharge process of the rechargeable battery. Therefore the diode stack provides a way of protecting the transistors when the regulator is in the off state without incurring any significant current penalty.

As noted earlier, the transistors are in series and without the presence of the diode stacks 70 and 72 would have to pass the same current. However the presence of the diode stacks 70 and 72 now provides additional current flow paths in the event that there is a slight imbalance between the transistors. The transistor currents when they are on should be accurately matched because $V_{gs}$ and $V_{bs}$ (back-gate to source voltage) are well matched, but even if they were not then in the worse case scenario represented by line 86 the diode stacks would allow an imbalance of approximately 500 μA to occur between the current mirrors before either one of the transistors came close to its maximum operating voltage. When the transistors are off the leakage current is expected to be dominated by leakage through the source and drain junctions. This will not be matched because the source, drain and back-gate voltages of the devices will be different.

Returning to FIG. 1, it can be seen that the circuits 10 and 12 controlling the current flow through the transistors M1 and M2 receive their power from downstream of the transistors. Therefore having switched the transistors M1 and M2 into a non-conducting state no power is available for circuits 10 and 12. In order to overcome this a start up circuit is provided comprising transistors Q8, Q9 and Q10. It will be assumed that another part of the device handles a start up process and can provide a voltage, typically equal to the digital supply voltage to a "switch on" node 90. This node is connected to a collector of NPN transistor Q8 via a P-type FET 92 and a current limiting resistor 94. Q8 has its emitter connected to the supply rail $V_{SS}$ and its base connected to its collector such that it forms the "master" transistor of a current mirror involving transistors Q9 and Q10. Q9 is connected in parallel with Q1 and Q10 is connected in parallel with Q2. Consequently when a turn on voltage is provided to the node 90 a current defined by resistor 94 flows through Q8 and is mirrored into transistors Q9 and Q10 which turn on thereby enabling a start up current to flow through transistor M3 and transistor M4. This in turn causes transistors M1 and M2 to become conducting. As these transistors become conducting the output voltage at the output node $V_{out}$ starts to rise until such time as the output voltage is sufficient in order to turn circuits 10 and 12 on into their operational states. Once this occurs, it then becomes desirable to switch off the start up circuit in order to avoid conflict between the current passing through transistors Q9 and Q10 and the control loop formed by circuit blocks 10 and 12. In order to do this a bias detection circuit 96 is provided which monitors the build up of voltage on the output node 6 and once it has reached a threshold voltage sufficient to guarantee normal operation of the circuits 10 and 12, then the bias circuit 96 outputs a signal on control line 98 which is provided to the gate of the P-type field effect transistor 92 so as to switch the transistor into a non-conducting state thereby turning off current flow through Q8, Q9 and Q10.

It is thus possible to provide a low drop out voltage regulator which uses two field effect transistors in series to drop a voltage which, in the worst case scenario, can safely exceed the individual breakdown voltages of each transistor. Furthermore, by implementing the voltage sharing function across the transistors by a controller loop using current mirrors, then the transistors can also perform maximum current limiting. It is thus possible to provide a reliable voltage regulator which can be fabricated using low voltage CMOS technology without requiring any additional processing steps.

What is claimed is:

1. A low drop out voltage regulator, comprising first and second field effect transistors arranged in series between a regulator input and a regulator output;

a third field effect transistor co-operating with the first field effect transistor to form a first current mirror;

a fourth field effect transistor co-operating with the second field effect transistor to form a second current mirror;

first and second control transistors connected in series with the third and fourth field effect transistors respectively so as to control the current flowing therein; and a controller for providing a control signal to the first and second control transistors as a function of a voltage at the regulator output.

2. A low drop out voltage regulator as claimed in claim 1, further comprising a first voltage limiter in parallel with the first field effect transistor and a second voltage limiter in parallel with the second field effect transistor.

3. A low drop out voltage regulator as claimed in claim 2, in which the first voltage limiter comprises a first plurality of a semiconductor devices arranged in series, and the second voltage limiter comprises a second plurality of semiconductor devices arranged in series.

4. A low drop out voltage regulator as claimed in claim 3, in which semiconductor devices comprise a plurality of diodes or a plurality of diode connected transistors.

5. A low drop out voltage regulator as claimed in claim 1, in which the control transistors are first and second bipolar transistors or are series connected MOS transistors.

6. A low drop out voltage regulator as claimed in claim 5, in which the first and second bipolar transistors are driven by at least one further current mirror and wherein the current in the current mirror is limited so as not to exceed a first threshold.

7. A low drop out voltage regulator as claimed in claim 6, in which the first threshold is selected based on properties of the first and second current mirrors such that the current through the first and second field effect transistors is limited to a threshold value.

8. A low drop out voltage regulator as claimed in claim 1, in which the first and second transistors are formed in individual wells in a semiconductor substrate such that each transistor has a back-gate connected to a source terminal.

9. A low drop out voltage regulator as claimed in claim 5, in which the first and second bipolar transistors are parasitic transistors resulting from formulation of field effect transistors in a triple well process.

10. A low drop out voltage regulator as claimed in claim 1, in which the field effect transistors have a first breakdown voltage less than the maximum working input voltage of the regulator and the control transistors have a breakdown voltage in excess of the maximum working input voltage of the regulator.

11. A low drop out voltage regulator as claimed in claim 1, in which the controller forms a control current which increases when the output voltage at the regulator output falls below a target output voltage.

12. A low drop out voltage regulator as claimed in claim 1, in which the controller receives its power from the output of the voltage regulator.

13. A low drop out voltage regulator as claimed in claim 12, further including a start-up circuit for initiating conduction of current through the first and second field effect transistors so that the voltage at the output of the regulator rises sufficiently for the controller to operate.

14. A low drop out voltage regulator as claimed in claim 1, further comprising a first resistor connected between a gate and a source of the first field effect transistor so as to bias the transistor off when no current is flowing in the third field effect transistors.

15. A low drop out voltage regulator as claimed in claim 1, in which the first and second field effect transistors are larger than the third and fourth field effect transistors.

16. A low drop out voltage regulator as claimed in claim 1, in combination with a rechargeable battery, wherein the rechargeable battery is connected to the regulator input.

* * * * *